US006336412B2

(12) United States Patent
Heimbrock et al.

(10) Patent No.: US 6,336,412 B2
(45) Date of Patent: Jan. 8, 2002

(54) PIVOTING HAND TABLE

(75) Inventors: Richard H. Heimbrock, Cincinnati, OH (US); Terry J. Simpkins, Sr.; Terry J. Simpkins, Jr., both of Carlsbad, CA (US); R. Kelly Simpkins, Mammoth Lakes, CA (US); David P. Harris, Chicago, IL (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/747,883

(22) Filed: Dec. 22, 2000

Related U.S. Application Data

(62) Division of application No. 09/321,188, filed on May 27, 1999.

(51) Int. Cl.[7] ..... A47B 23/00
(52) U.S. Cl. ..... 108/42; 108/157
(58) Field of Search ..... 5/623, 621, 624, 5/646, 647, 648, 650, 507.1; 403/52, 68; 108/42, 48, 44, 157.1, 157.13, 157.11, 152; 248/439, 188.6, 188.1, 188

(56) References Cited

U.S. PATENT DOCUMENTS

| | | | | |
|---|---|---|---|---|
| 541,863 A | | 7/1895 | Loomis | |
| 1,740,183 A | * | 12/1929 | Lenney et al. | 108/48 X |
| 2,437,162 A | * | 3/1948 | Keller | 108/48 |
| 2,609,261 A | | 9/1952 | Parker | |
| 2,721,777 A | * | 10/1955 | Willis | 108/48 X |
| 2,801,142 A | | 7/1957 | Adams | |
| 2,833,608 A | * | 5/1958 | Tobias | 108/48 |
| 2,867,484 A | * | 1/1959 | Jennings | 108/48 X |
| 2,972,505 A | | 2/1961 | Weickgenannt | |
| 3,041,121 A | | 6/1962 | Comper | |
| 3,057,670 A | * | 10/1962 | Russo | 108/48 X |
| 3,124,328 A | | 3/1964 | Kortsch | |
| 3,528,413 A | | 9/1970 | Aydt | |
| 4,313,385 A | * | 2/1982 | Fitzgerald | 108/48 X |
| 4,564,180 A | | 1/1986 | Agee et al. | |
| 4,702,465 A | | 10/1987 | McConnell | |
| 4,858,903 A | | 8/1989 | Tari et al. | |
| 5,104,103 A | | 4/1992 | Auchinleck et al. | |
| 5,135,210 A | | 8/1992 | Michelson | |
| 5,335,384 A | | 8/1994 | Foster et al. | |
| 5,718,671 A | | 2/1998 | Bzoch | |
| 5,758,374 A | | 6/1998 | Ronci | |
| 5,839,136 A | | 11/1998 | Vance et al. | |
| 5,864,902 A | | 2/1999 | Rogers | |

* cited by examiner

*Primary Examiner*—Jose V. Chen
(74) *Attorney, Agent, or Firm*—Barnes & Thornburg

(57) ABSTRACT

A hand table assembly includes a platform having a longitudinal central axis and a platform attachment apparatus for coupling the platform to a patient support deck generally in a horizontal plane and at a 90° angle, a platform support leg, and a platform support leg attachment mechanism. The platform support leg attachment mechanism includes a leg-receiving receptacle coupled to the underside of the platform, a lower bracket coupled to a head end of the support leg, the lower bracket having an outwardly-extending portion at one end thereof, an upper bracket supported on the lower bracket and having an outwardly-extending portion at one end thereof which is pivotably coupled to the outwardly-extending portion of the lower bracket about a first axis disposed generally transversely to the longitudinal central axis of the platform, a lower latch coupled to the lower bracket at the other end thereof configured to releasably secure the other end of the upper bracket to the other end of the lower bracket, and an upper latch coupled to the upper bracket configured to releasably secure the upper bracket to the leg-receiving receptacle.

68 Claims, 6 Drawing Sheets

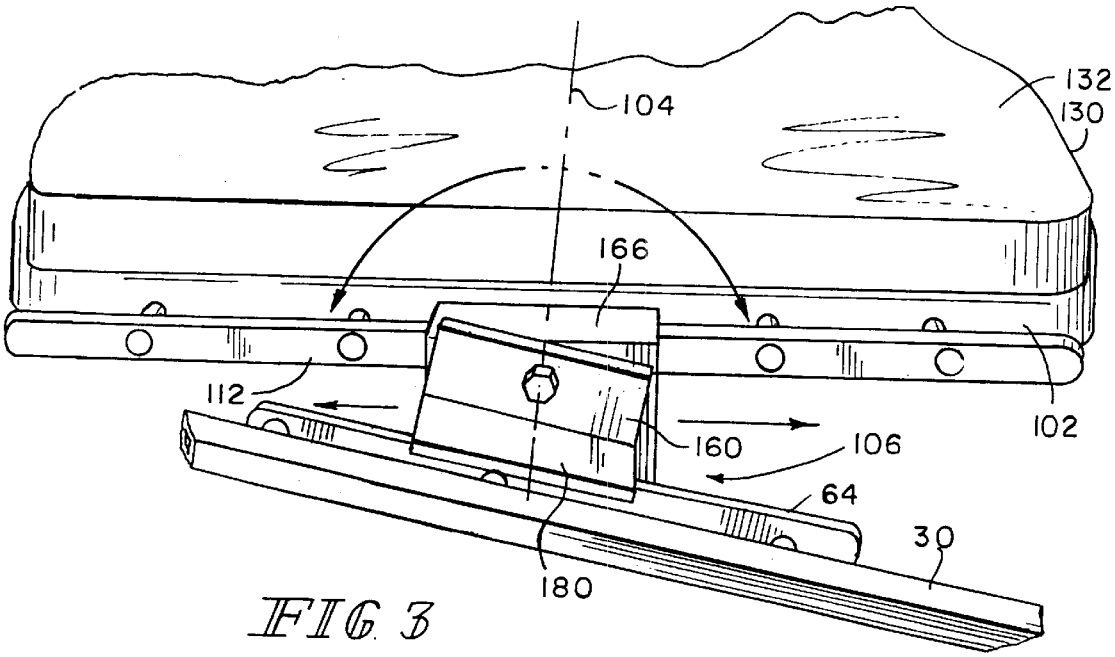
FIG. 3
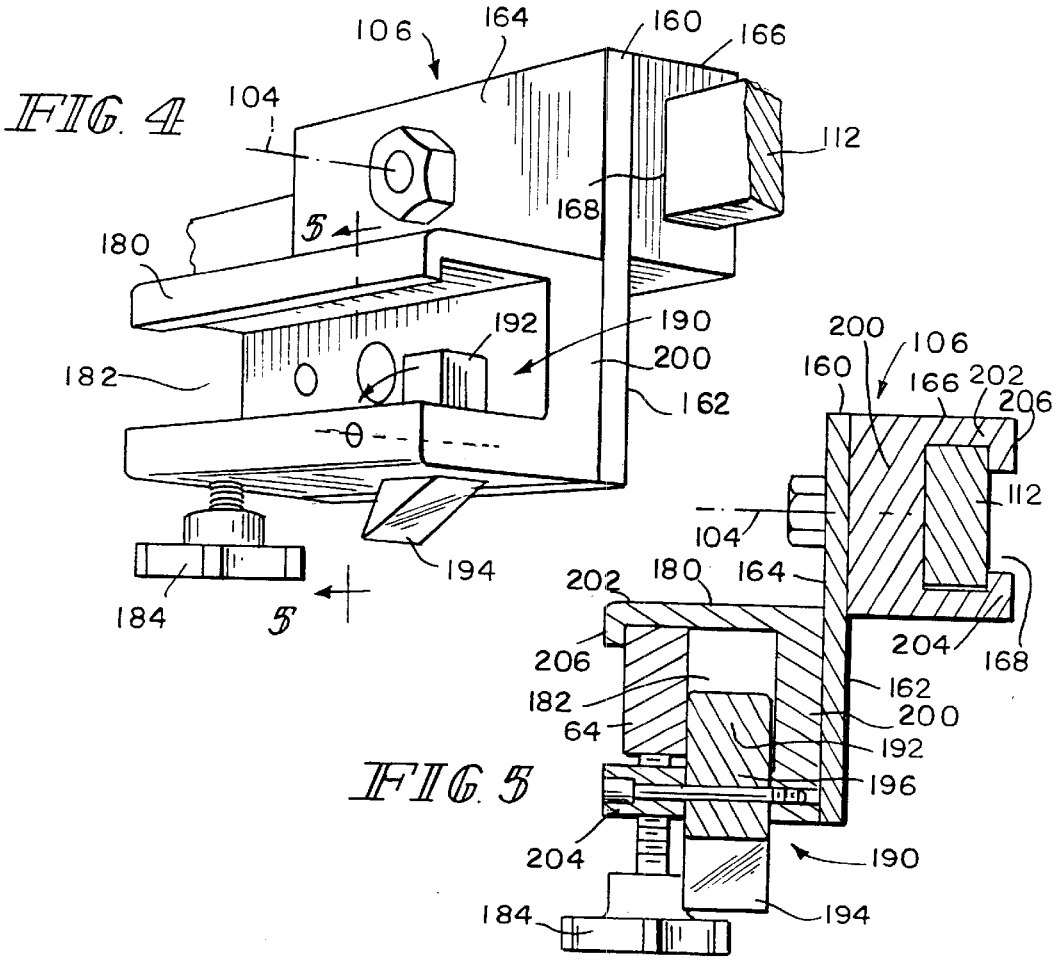
FIG. 4
FIG. 5

PIVOTING HAND TABLE

This is a divisional of a copending U.S. patent application, Ser. No. 09/321,188, filed on May 27, 1999, and entitled "Pivoting Hand Table".

BACKGROUND AND SUMMARY OF THE INVENTION

The present invention generally relates to patient support decks such as hospital stretchers, surgical operating tables and hospital beds, and particularly to hand table or armboard assemblies for such patient support decks. More particularly, the present invention relates to hand table assemblies suitable for hand or arm surgeries.

Various surgical tables having articulated table tops have been developed to meet the growing demand of surgical tables which may be used for a wide variety of different surgical procedures. Among the functions desirable for a surgical table is the ability to articulate the back section with respect to the seat section about a transverse axis.

For hand or arm surgeries, a hand table or armboard is attached to a surgical rail of an operating room table or a hospital stretcher at a 90° angle to the longitudinal axis of the patient support surface. It is known to pivot the hand tables about a vertical axis in the plane of the patient support surface as shown in U.S. Pat. No. 2,972,505.

Another arrangement for supporting a hand table or armboard is shown in U.S. Pat. No. 5,135,210. As shown therein, the armboard 52 is mounted to a novel adapter 100, which includes a horizontal shaft 102 disposed generally parallel to a longitudinal axis of the patient support surface. The generally horizontal shaft 102 is, in turn, mounted to a conventional surgical accessory socket 18 that is commonly used for attaching various accessories to a surgical operating table. This configuration allows two additional degrees of freedom to the armboard 52. The armboard 52 can pivot about the axis of a horizontal shaft 102 disposed generally parallel to the longitudinal axis of the patient support surface as shown in FIG. 7. In addition, the armboard 52 can pivot about the axis of the surgical accessory socket 18 extending perpendicularly to the longitudinal axis of the patient support surface 36 as shown in FIG. 8.

The prior art arrangements, however, do not allow the head of a patient resting on the surgical stretcher to be raised prior to, during or after a surgical procedure. The ability to raise a patient's head is particularly important for patients with respiratory problems. The present invention provides the ability to raise a patient's head without tilting the hand table about its longitudinal central axis. In accordance with this invention, the hand table is mounted to pivot about its longitudinal central axis so that it can remain parallel to the floor even when the back section of the stretcher is elevated.

In an illustrated embodiment of the invention, the hand table assembly includes a platform having a longitudinal central axis and a platform attachment apparatus for coupling the platform to a patient support deck generally in a horizontal plane and at a 90° angle. The platform attachment apparatus illustratively includes a first member configured to be mechanically coupled to an inboard end of the platform and a second member configured to be mechanically coupled to a side rail of an articulatable back section of the patient support deck. The first member is pivoted relative to the second member about the longitudinal central axis of the platform such that the platform remains generally parallel to the floor when the articulatable back section is articulated.

According to another embodiment, the platform attachment apparatus includes a generally planar supporting plate having first and second oppositely-disposed sides. A first outwardly-projecting member is pivotally coupled to the supporting plate on a first side thereof for rotation about the longitudinal central axis of the hand table. The first outwardly-projecting member includes a first rail-receiving channel disposed generally perpendicularly to the longitudinal central axis of the platform and sized for slidably receiving an end rail secured to an inboard end of the platform. A first clamp is mechanically coupled to the first outwardly-projecting member for selectively clamping the platform end rail upon its reception in the first rail-receiving channel. A second outwardly-projecting member is mechanically coupled to the supporting plate on the second side thereof. The second outwardly-projecting member includes a second rail-receiving channel facing away from the first rail-receiving channel and also disposed generally perpendicularly to the longitudinal central axis of the platform for slidably receiving a side rail secured to the articulate back section. A second clamp is mechanically coupled to the second outwardly-projecting member for selectively clamping the side rail upon its reception in the second rail-receiving channel.

In accordance with still another embodiment of the invention, the first and second rail-receiving channels are offset with respect to each other in a direction perpendicular to the longitudinal central axis of the platform so that the top surface of a cushion supported on the hand table assembly is generally disposed at the same level as the top surface of a mattress disposed on the patient support deck.

According to still further embodiment of the present invention, the hand table assembly includes a platform support leg and a platform support leg attachment mechanism. The platform support leg attachment mechanism illustratively includes a leg-receiving receptacle coupled to the underside of the platform, an upper bracket configured to be coupled to the leg-receiving receptacle and a lower bracket coupled to the platform support leg. The lower bracket has an outwardly-extending portion at one end thereof. The upper bracket also has an outwardly-extending portion at one end thereof which is pivotably coupled to the outwardly-extending portion of the lower bracket about a first axis disposed generally transversely to the longitudinal central axis of the platform. A lower latch coupled to the lower bracket at the other end thereof is configured to releasably secure the other end of the upper bracket to the other end of the lower bracket. An upper latch coupled to the upper bracket is configured to releasably secure the upper bracket to the leg-receiving receptacle.

According to the present invention, the platform support leg attachment mechanism includes a support leg storage latch comprising a retaining pin secured to the underside of the platform at one end thereof (e.g., inboard end). The support leg, mounted at the other end of the platform (e.g., outboard end), can be folded and locked in a storage position under the platform by pivoting the platform support leg about the first axis so that it extends generally parallel to the length dimension of the platform on the underside thereof and extending the support leg to cause the retaining pin to enter a retaining pin-receiving receptacle disposed in a foot end of the support leg to lock it in place. The platform support leg illustratively includes at least two telescopic sections and a latch for locking the telescopic sections in place.

Additional features of the present invention will become apparent to those skilled in the art upon a consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 3 is a perspective view of the hand table platform attachment mechanism with portions broken away and showing a supporting plate, a first outwardly-projecting member pivotally coupled to the supporting plate on a first side thereof for rotation about a longitudinal central axis of the platform, the first outwardly-projecting member including a first rail-receiving channel disposed generally perpendicularly to the longitudinal central axis of the platform and sized for slidably receiving a platform end rail, a second outwardly-projecting member mechanically coupled to the supporting plate on a second side thereof, the second outwardly-projecting member including a second rail-receiving channel facing away from the first rail-receiving channel and also disposed generally perpendicularly to the longitudinal central axis of the platform for slidably receiving a side rail secured to the back section, the second rail-receiving channel having thickness greater than a conventional surgical rail, FIG. 4 is a perspective view of the platform attachment mechanism showing a thumb screw for clamping a side rail received in the second rail-receiving channel, and further showing a flip-over lever pivotally mounted to the second outwardly-projecting member for movement between a deployed up position and an out-of-the-way down position, the flip-over lever having a first end extending into the second rail-receiving channel when deployed, the detent portion when deployed reducing the thickness of the second rail-receiving channel so that a conventional surgical rail can be snugly received therein and clamped.

FIG. 5 is a sectional view showing the platform attachment mechanism along a line 5—5 in FIG. 4, and further showing the first end of the flip-over lever extending into the second rail-receiving channel, a conventional surgical rail snugly received in the second rail-receiving channel, a thumb screw for clamping the conventional surgical rail received in the second rail-receiving channel, and a hand table platform end rail snugly received in the first rail-receiving channel and clamped.

DETAILED DESCRIPTION OF THE DRAWINGS

The present invention will be described primarily as a hand table assembly to be attached to a surgical stretcher, but it will be understood that the same may be used in conjunction with any surgical operating table or a hospital bed.

Figure 1:
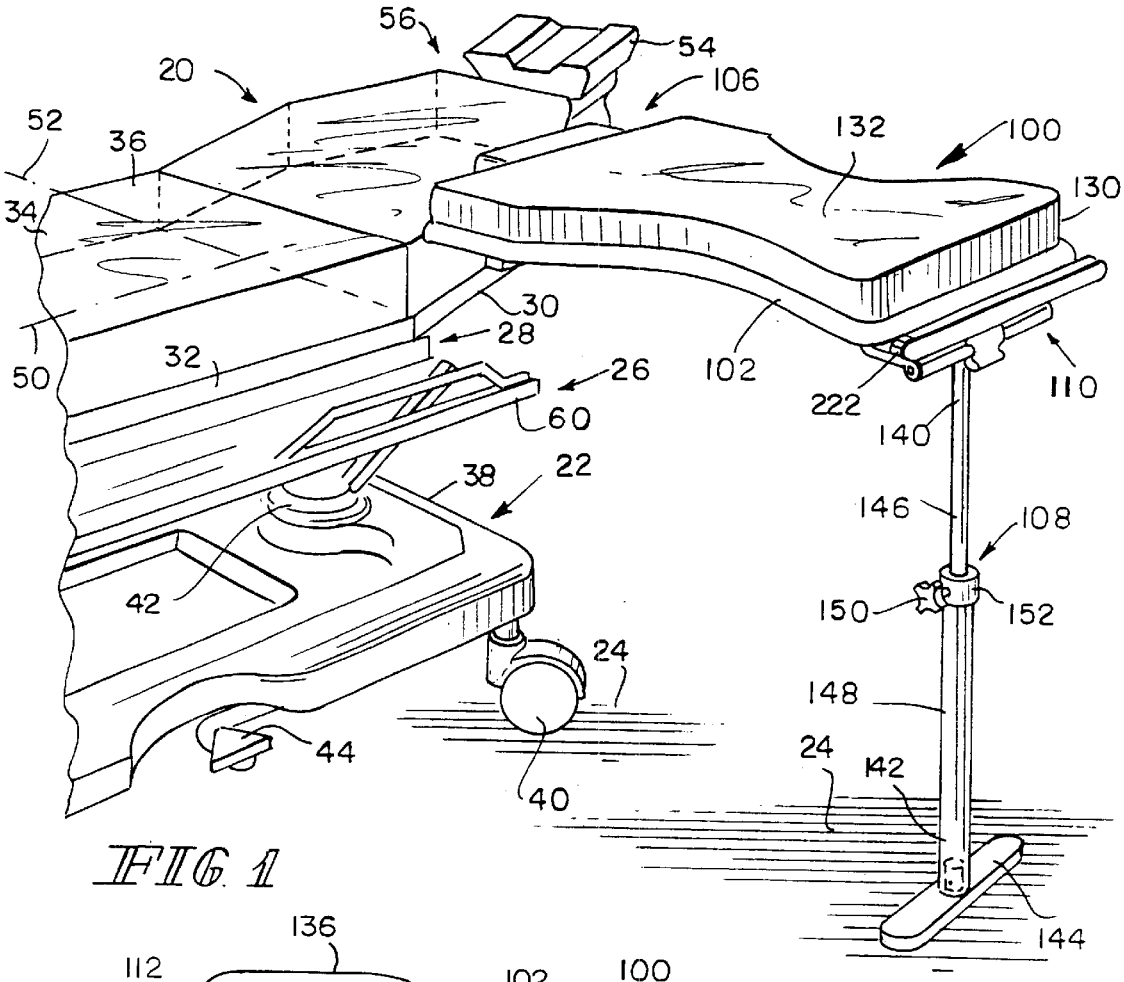
FIG. 1 is a partial perspective view showing a hand table assembly of the present invention coupled to an articulated back section of a hospital stretcher, and further showing the hand table disposed generally parallel to the floor while the articulated back section is raised so that a patient's hand can comfortably rest on the hand table.
Figure 2:
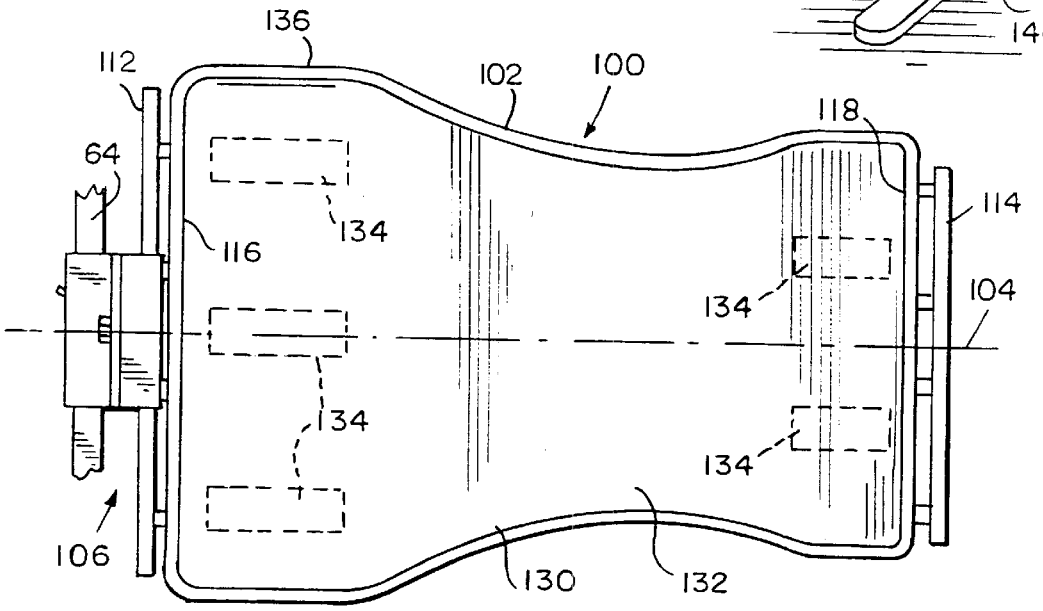
FIG. 2 is a top plan view of the hand table of FIG. 1 showing an end rail secured to each end of the hand table and a hand table platform attachment mechanism for securing a hand table platform to a back section of a patient support deck at a 90° angle, and further showing Velcro (trademark) pads for securing a cushion supported on the hand table platform.

As shown in FIGS. 1 and 2, a surgical stretcher 20 includes a base frame 22 supported on a floor 24, an intermediate frame 26 coupled to the base frame, and an articulated patient support deck 28 mounted to the intermediate frame. The articulated patient support deck 28 includes longitudinally spaced-apart back section 30, seat section 32, and leg and foot sections (not shown), which are coupled to the intermediate frame 26 for movement relative to one another and relative to the intermediate frame. A mattress 34, disposed on the patient support deck 28, has an upwardly-facing patient support surface 36 upon which a patient can rest.

The base frame 22 is covered by a protective shroud 38 to shield various mechanisms mounted to the base frame from view and to prevent foreign objects from being inadvertently inserted therein. Relatively large casters 40, mounted at each corner of the base frame 22, extend downwardly therefrom to engage the floor 24. The intermediate frame 26 is supported above the base frame 22 by a pair of longitudinally spaced-apart elevation mechanisms 42, well-known to those skilled in the art. The elevation mechanisms 42 are each covered by a protective boot to shield the elevation mechanisms from view and to prevent foreign objects from being inadvertently inserted into the elevation mechanisms. The stretcher 20 includes a plurality of foot pedals 44 coupled to the elevation mechanisms 42. Different foot pedals can be depressed to activate appropriate elevation mechanisms 42 to raise, lower or tilt the intermediate frame 26 and the patient-support deck 28 with respect to the floor 24.

The stretcher 20 includes a conventional brake and steer mechanism (not shown). The brake and steer mechanism includes a caster braking mechanism (not shown) which brakes the casters 40 to prevent them from rotating and swivelling when a brake-steer shaft is rotated to a braking position. The brake-steer mechanism further includes a steering mechanism (not shown) which lowers a center wheel (not shown) into engagement with the floor 24 when the brake-steer shaft is rotated to a steering position to enable the operator to steer the stretcher 20. Additional details of the many of the above-referenced mechanisms can be found in the U.S. Pat. No. 5,806,111, assigned to the same assignee as the present invention, which is incorporated by reference herein.

Figure 14:
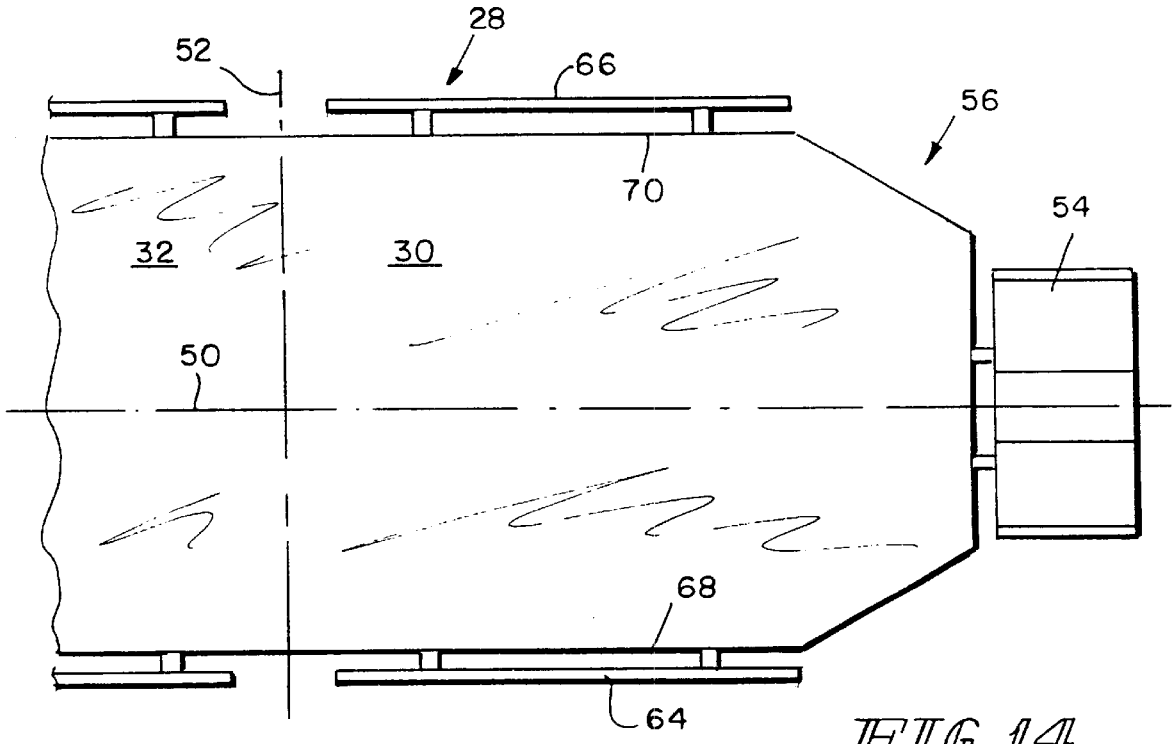
FIG. 14 is a plan view of the patient support deck including an articulated back section pivotally mounted to a seat section about a transverse axis, and first and second side rails secured to first and second sides of the back section respectively for supporting various surgical accessories.

As shown in FIG. 14, the patient support deck 28 has a longitudinal axis 50 that extends parallel to its length dimension. At least the back section 30 is pivotally mounted to the seat section 32 about a generally horizontal transverse axis 52 extending perpendicularly to the longitudinal axis of the patient support deck 28 for movement between a generally horizontal lying-down position and a reclining sitting-up position. The leg and foot sections may be also pivotally mounted to the seat section 32 for articulation. The back section 30 is lockable relative to the seat section 32 in an infinite number of positions between the lying-down and sitting-up positions. A head rest 54 is coupled to the back section 30 adjacent to a head end 56 of the patient support deck 28.

Again referring to FIG. 1, the stretcher 20 includes side rail assemblies 60 movably mounted on each side of the stretcher by means of conventional 4-bar linkage mechanisms well-known to those skilled in the art. The side rail assemblies 60 are movable between (I) a down-out-of-the-way position in which the side rail assemblies are disposed below the patient support surface 36 to provide maximum access to a patient resting on the patient support surface, and (ii) a raised position in which the side rail assemblies are elevated above the patient support surface to prevent a patient resting on the patient support surface from inadvertently falling off.

As shown in FIG. 14, the articulatable back section 30 of the stretcher 20 is equipped with back section side rails 64 and 66 secured to first and second sides 68 and 70 of the back section for the purpose of accepting various accessories which are attached to the side rails by means of standard surgical accessory sockets in a manner well-known to those skilled in the art. The back section side rails 64 and 66 extend slightly below the patient support deck 28 and away from the sides 68 and 70 of the back section 30 creating a space between the side rails and the sides of the patient support deck for attachment of the surgical accessory sockets. The surgical accessory sockets are free to move along the length of the back section side rails 64 and 66 so that the accessories can be positioned at suitable locations. The side rails 64 and 66 generally have the same rectangular cross-section as a standard surgical rail (i.e., 1" high and ⅝" wide). Likewise, as shown in FIG. 14, the seat section 32 may also be equipped with seat section side rails on both sides thereof. As mentioned above, the U.S. Pat. No. 5,135,210 illustratively describes one arrangement for attaching a hand table to a back section side rail of a stretcher via a surgical accessory socket. U.S. Pat. No. 5,135,210 is incorporated herein by reference to establish the nature of surgical armboards.

As shown in FIGS. 1 and 2, a surgical hand table or armboard assembly 100, designed as a cantilevered structure, is coupled to the surgical stretcher 20 generally in a horizontal plane and at a 90° angle to the longitudinal axis 50 of the patient support deck 28. The hand table assembly 100 includes a generally planar platform 102 having a longitudinal central axis 104, a platform attachment mechanism 106 for releasably coupling the hand table assembly to the patient support deck 28, a vertically-extendible platform support leg 108, and a platform support leg attachment mechanism 110 for releasably coupling the platform support leg to the platform.

Referring to FIG. 2, the generally planar platform 102 has an hourglass shape with one end broader than the other. The platform 102 includes first and second end rails 112 and 114 coupled to inboard and outboard ends 116 and 118 of the platform in a direction generally perpendicularly to the longitudinal central axis 104 of the platform. The platform 102 is configured to be coupled to the patient support deck 28 at either end 116 or 118 of the platform. The ability to couple the platform 102 at either end thereof provides more space at an end of the platform 102 where it is most appropriate for the type of surgery, either close or away from a patient resting on the patient support deck 28. The platform end rails 112 and 114, like the back section side rails 64 and 66, have generally the same rectangular cross-section as a standard surgical rail (i.e., 1" high and ⅝" wide).

Likewise, the platform 102 is further configured to be coupled to the patient support deck 28 on either side 68 or 70 of the patient support deck. Thus, for a right arm surgery the platform 102 can be coupled to the right side of the patient support deck 28, and for a left arm surgery the platform can be coupled to the left side of the patient support deck.

A cushion 130, having an upwardly-facing surface 132, is attached to the platform 102 by Velcro (trademark) pads 134 to provide a cushioned surface for a patient's arm. The peripheral edge of the platform 102 is rounded, and covered with a protective coating of soft material 136 with a tough outer layer to avoid tearing.

As shown in FIG. 1, the vertically-extendible platform support leg 108 has a head end 140 coupled to the platform 102 and a foot end 142 coupled to a foot plate 144 configured to be supported by the floor 24. The support leg 108 comprises an inner tube 146 that is telescopically received in an outer tube 148. A thumb screw 150 engages a threaded opening in a sleeve 152 secured to an upper end of the outer tube 148. The distal end of the thumb screw 150 engages the inner tube 146 to lock it in any suitable position to adjust the height of the platform support leg 108.

Referring to FIGS. 3–6, the platform attachment mechanism 106 includes a generally planar supporting plate 160 having first and second oppositely-disposed sides 162 and 164. A first outwardly-projecting member 166 is pivotally coupled to the supporting plate 160 on the first side 162 thereof for rotation about the longitudinal central axis 104 of the platform 102. The first outwardly-projecting member 166 includes a first rail-receiving channel 168 disposed generally perpendicularly to the longitudinal central axis 104 of the platform 102 for slidably receiving either of the two platform end rails 112 and 114. As can be seen from FIG. 6, a first thumb screw 170 engages a threaded opening in the first outwardly-projecting member 166. The distal end of the thumb screw 170 engages a platform end rail 112 received in the first rail-receiving channel 168 to clamp the platform attachment mechanism 106 anywhere along the platform end rail. This provides the ability to adjust the side-to-side position of the platform 102 relative to a patient's arm when the back section 30 is elevated as shown in FIG. 3.

A second outwardly-projecting member 180 is mounted to the supporting plate 160 on the second side 164 thereof. The second outwardly-projecting member 180 includes a second rail-receiving channel 182 facing away from the first rail-receiving channel 168 and disposed generally perpendicularly to the longitudinal central axis 104 of the platform 102 for slidably receiving either of the two back section side rails 64 and 66 of the articulatable back section 30. As can be seen from FIGS. 5 and 6, a second thumb screw 184 engages a threaded opening in the second outwardly-projecting member 180. The distal end of the thumb screw 184 engages a back section side rail received in the second rail-receiving channel 182 to clamp the platform attachment mechanism 106 anywhere along the side rail. This provides the ability to adjust the height of the platform 102 when the back section 30 is elevated as shown in FIG. 1.

Figure 6:
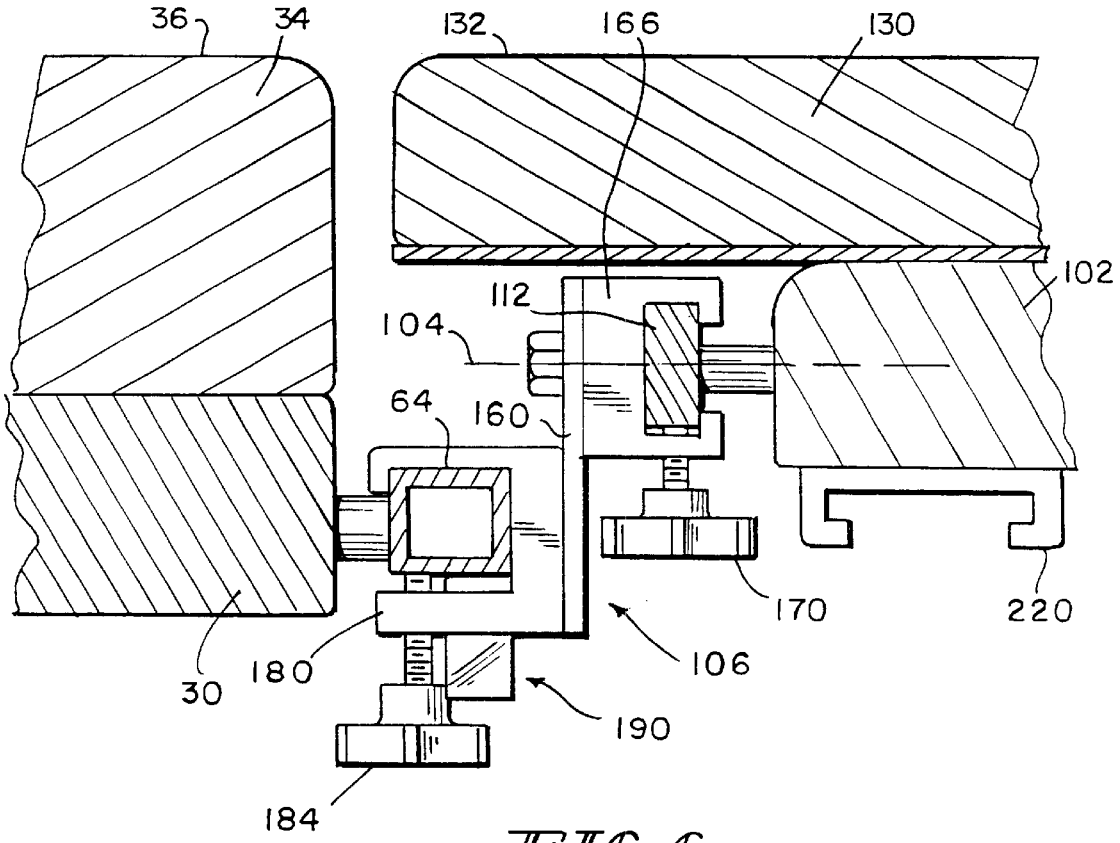
FIG. 6 is a view similar to FIG. 5, except that a wider-than-conventional surgical rail is snugly received in the second rail-receiving channel and clamped, and further showing the flip-over lever in the out-of-the-way down position, and a platform end rail snugly received in the first rail-receiving channel and clamped.

The first and second rail-receiving channels 168 and 182 are offset with respect to each other, as shown in FIG. 6, in a direction perpendicular to the longitudinal central axis 104 of the platform 102 so that the upwardly-facing surface 132 of the cushion 130 supported on the platform 102 is generally at the same level as the upwardly-facing surface 36 of a mattress 34 supported on the patient support deck 28.

The platform attachment mechanism 106 is configured to attach to either (I) a standard surgical side rail of a surgical stretcher or a surgical operating table (i.e., 1" high and ⅝" wide) or (ii) a one-inch square tube side rail of a conventional stretcher (i.e., 1" high and 1" wide) so as to provide the ability to attach the hand table assembly 100 to either a surgical side rail or a conventional side rail. To this end, the second rail-receiving channel 182 is oversized to fit a one-inch square tube as shown in FIGS. 4–6. A flip-over lever 190 is movably coupled to the second outwardly-projecting member 180. The flip-over lever 190 has a first end 192 extending into the second rail-receiving channel 182 when deployed, a second end 194 providing a handle portion, and a middle portion 196 coupled to the second outwardly-projecting member 180 for pivoting movement between (I) a deployed up position, shown in FIGS. 4 and 5, in which a first end 192 of the flip-over lever extends into the oversized second rail-receiving channel 182, and (ii) an out-of-the-way down position, shown in FIG. 6, in which the first end of the flip-over lever is outside the oversized second rail-receiving channel. The first end 192 of the flip-over lever 190 reduces the thickness of the oversized second rail-receiving channel 182 to closely fit a conventional surgical side rail when the first end of the flip-over lever is positioned inside the second rail-receiving channel as shown in FIGS. 4 and 5. A not-illustrated spring, coupled to the flip-over lever 190, biases the flip-over lever toward the deployed up position when the flip-over lever is between an over-the-center position and the deployed up position, and biases toward the out-of-the-way down position when the flip-over lever is between the over-the-center position and the out-of-the-way down position.

As shown in FIG. 5, each rail-receiving channel 168 and 182 has a C-shaped configuration comprising a base portion 200 extending generally perpendicularly to the longitudinal central axis 104 of the platform 102, first and second arm portions 202 and 204 extending generally perpendicularly to the base portion and at least one lip portion 206 extending generally parallel to the base portion and spaced therefrom. The base portion 200, the arm portions 202 and 204 and the at least one lip portion 206 defining a rail-receiving space so as to prevent a rail received therein from moving transversely out of the rail-receiving channel.

Figure 7:
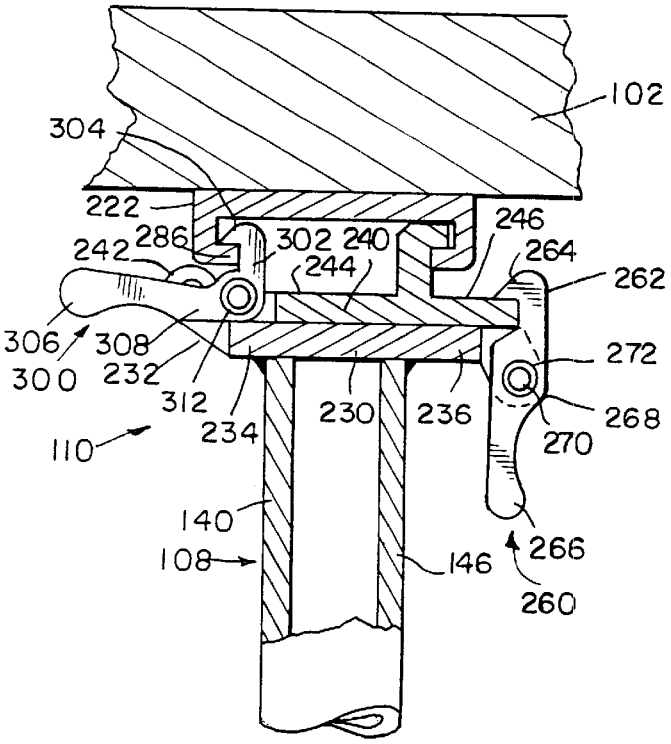
FIG. 7 is a sectional side view of a platform support leg attachment mechanism with portions broken away, and showing a leg-receiving receptacle coupled to the underside of the platform and having a downwardly-facing U-shaped channel, a lower bracket coupled to the platform support leg, and an upper bracket supported on the lower bracket configured to couple the lower bracket to the leg-receiving receptacle, the lower bracket having an outwardly-extending portion at one end thereof, the upper bracket also having an outwardly-extending portion at one end thereof which is pivotably coupled to the outwardly-extending portion of the lower bracket about a first axis disposed generally transversely to the longitudinal central axis of the platform, a lower latch coupled to the lower bracket at the other end thereof being configured to releasably secure the other end of the upper bracket to the other end of the lower bracket, and an upper latch coupled to the upper bracket to releasably secure the upper bracket to the leg-receiving receptacle, the upper latch being shown in a first orientation in which an outwardly-turned lip portion of a generally upwardly-extending portion of the upper latch engages an inwardly-turned lip portion of the leg-receiving receptacle to releasably secure the upper bracket to the receptacle.
Figure 8:
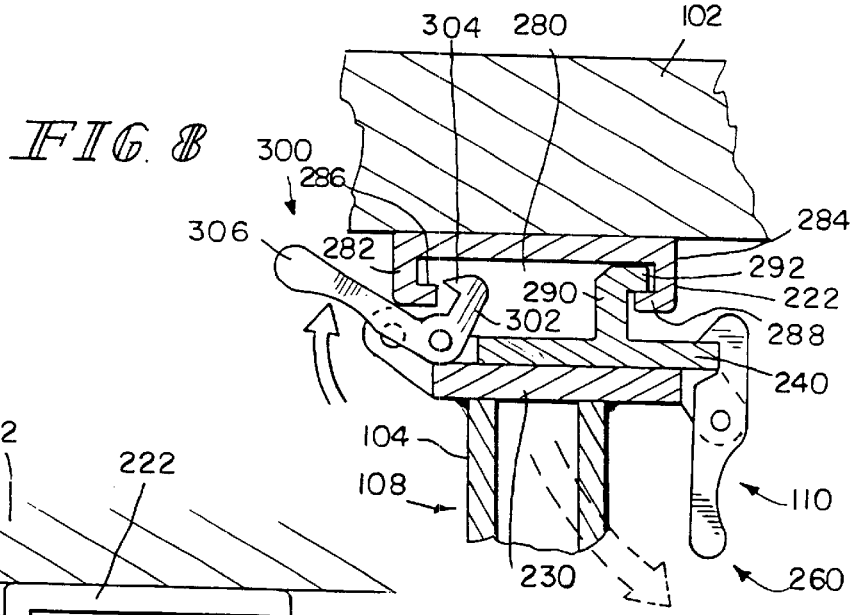
FIG. 8 is a view similar to FIG. 7, except that the upper latch is moved to a second orientation in which the outwardly-turned lip portion of the generally upwardly-extending portion of the upper latch disengages from the inwardly-turned lip portion of the leg-receiving receptacle to free the platform support leg.
Figure 9:
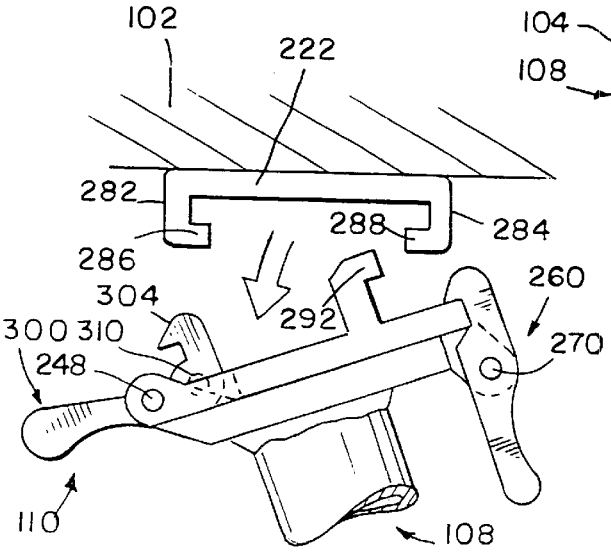
FIG. 9 is a view similar to FIG. 8, except that the platform support leg is pivoted and pulled down to remove it from the hand table assembly.
Figure 10:
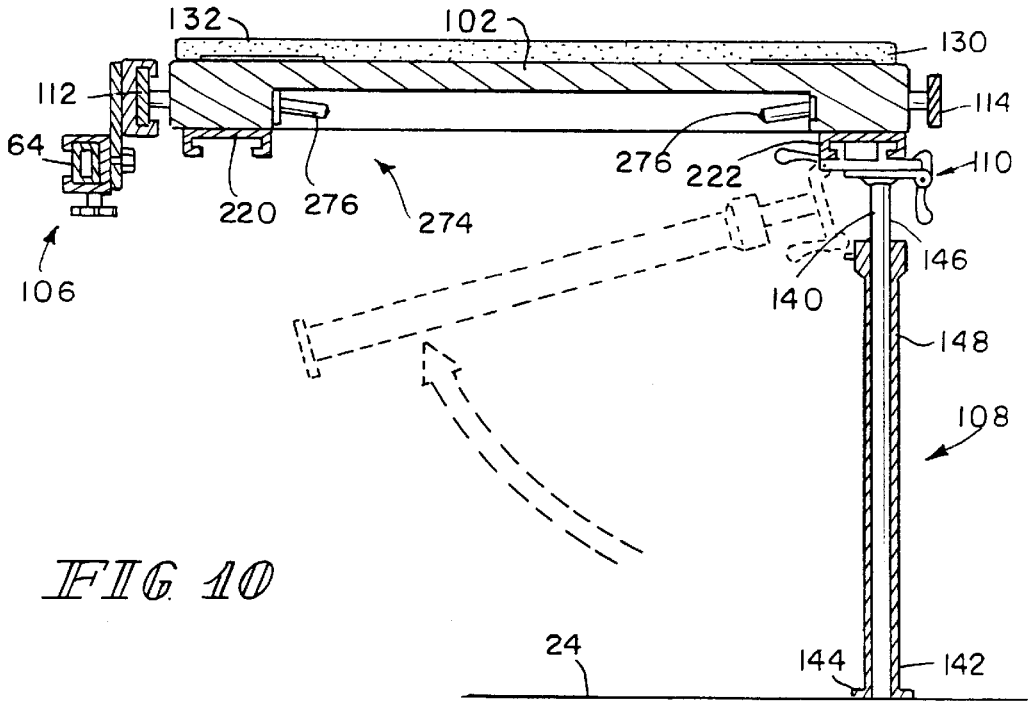
FIG. 10 is a sectional side view of the hand table assembly coupled to a back section side rail secured to a back section of a patient support deck (not shown) and showing a platform support leg releasably secured to the hand table platform at an outboard end thereof.

Referring to FIGS. 7–13 generally and FIGS. 7–9 particularly, the platform support leg attachment mechanism 110 includes two identical leg-receiving receptacles 220 and 222 coupled to the underside of the platform 102 at its inboard and outboard ends 116 and 118 respectively. As shown in FIG. 7, a generally planar lower bracket 230 is coupled to the head end 140 of the platform support leg 108. The lower bracket 230 has an outwardly-extending portion 232 at one end 234 thereof. A generally planar upper bracket 240 is supported by the lower bracket 230 on the top side thereof in a back-to-back arrangement as shown. The upper bracket 240 has an outwardly-extending portion 242 at one end 244 thereof which is pivotably coupled to the outwardly-extending portion 232 of the lower bracket 230 about a first axis 248 (see FIG. 9) disposed generally transversely to the longitudinal central axis 104 of the platform 102.

Again as shown in FIG. 7, a lower latch 260 is pivotally coupled to the lower bracket 230 at the other end 236 thereof. The lower latch 260 includes a generally upwardly-extending first portion 262, which has an inwardly-turned lip portion 264 adapted for engagement with the other end 246 of the upper bracket 240 for releasably securing the other end 246 of the upper bracket 240 to the other end 236 of the lower bracket 230. The lower latch 260 further includes a second generally downwardly-extending portion 266 providing a leg storage release handle, and a middle portion 268 pivotally coupled to the lower bracket 230 for pivoting movement about a second axis 270 disposed generally transversely to the longitudinal central axis 104 of the platform 102 between (i) a first orientation shown in FIG. 10 in which the inwardly-turned lip portion 264 of the generally upwardly-extending first portion 262 of the lower latch 230 engages the other end 246 of the upper bracket 240 for releasably securing the lower bracket 230 to the upper bracket 240, and (ii) a second orientation in which the inwardly-turned lip portion 264 of the generally upwardly extending first portion 262 of the lower latch 230 disengages from the other end 246 of the upper bracket 240 to free the platform support leg 108 to pivot about the first axis 248 as shown in FIG. 11.

The lower latch 260 further includes a spring 272 for biasing the lower latch toward the first orientation thereof in which the inwardly-turned lip portion 264 of the generally upwardly-extending first portion 262 of the lower latch 260 engages the other end 246 of the upper bracket 240 for releasably securing the lower bracket 230 to the upper bracket 240. As mentioned above, the lower latch 260 disengages from the other end 246 of the upper bracket 240 to free the platform support leg 108 to pivot about the first axis 248 for storage underneath the platform 102 in response to movement of the leg storage release handle 266.

Figure 11:
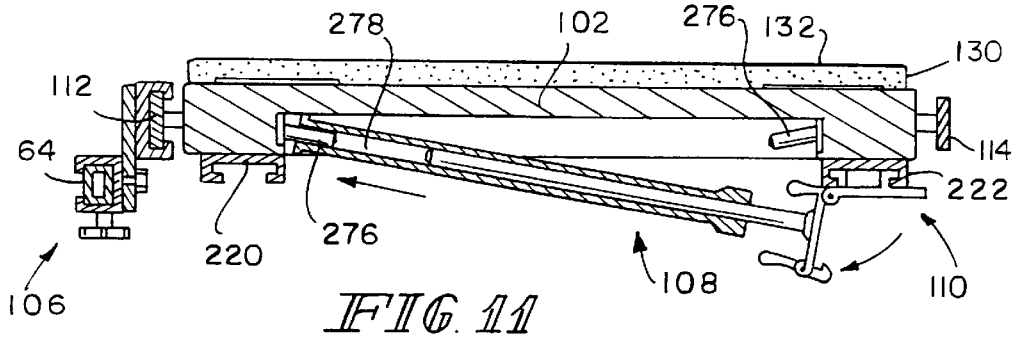
FIG. 11 is a view similar to FIG. 10, except that the platform support leg is folded and locked in a storage position under the platform by pivoting it so that it extends generally parallel to the length dimension of the platform on the underside thereof and then extending the platform support leg to cause a retaining pin secured to the underside of the platform at an inboard end thereof to enter a retaining pin-receiving receptacle disposed in a foot end of the platform support leg to lock it in place.
Figure 12:
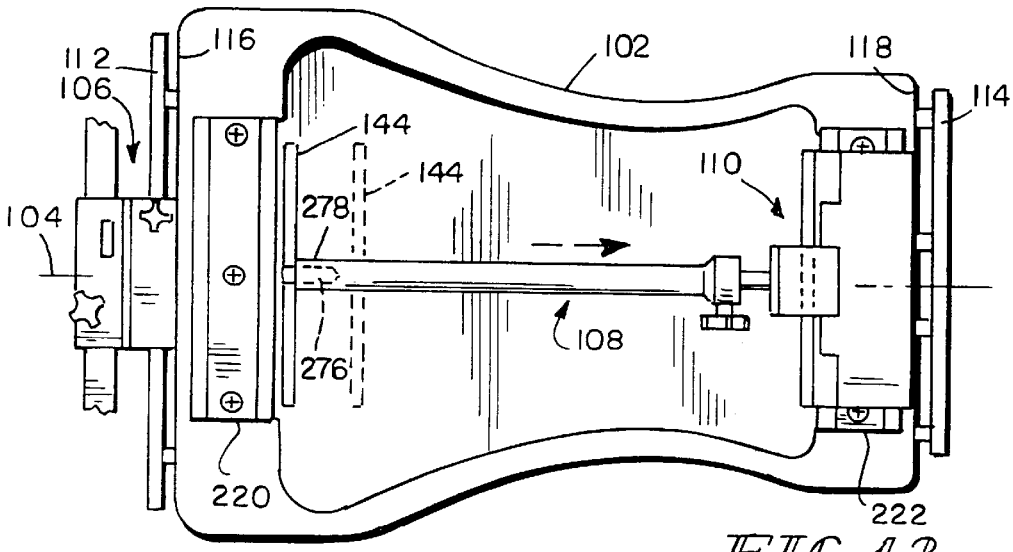
FIG. 12 is a bottom view of the hand table assembly with the platform support leg folded and locked in a storage position under the platform.
Figure 13:
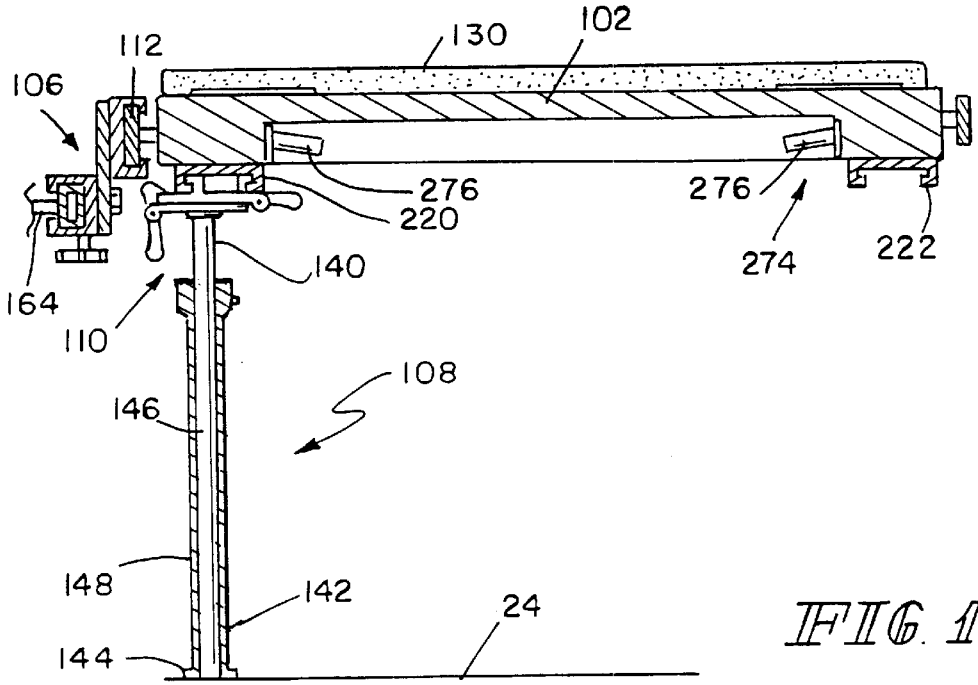
FIG. 13 is a view similar to FIG. 10, except that the platform support leg is secured to the hand table platform at the inboard end thereof instead of the outboard end.

As shown in FIGS. 10–13, the hand table assembly 100 includes a support leg storage latch 274 comprising first and second retaining pins 276 secured to the underside of the platform 102 at both inboard and outboard ends 116 and 118 thereof. The platform support leg 108 can be folded and locked in a storage position under the platform 102, as shown in FIGS. 11 and 12, by pivoting the platform support leg about the first axis 248 so that it extends generally parallel to the longitudinal axis 104 of the platform on the underside thereof and extending the support leg to cause a retaining pin to enter a retaining pin-receiving receptacle 278 disposed in the foot plate 144 of the platform support leg to lock it in place.

As described above, the platform support leg attachment mechanism 110 includes two identical leg-receiving receptacles 220 and 222 coupled to the underside of the platform 102. The leg-receiving receptacle 220 is coupled to the underside of the platform 102 at its inboard end 116, and the other leg-receiving receptacle 222 is coupled to the underside of the platform at its outboard end 118, as shown in FIGS. 10–13. Since the two leg-receiving receptacles 220 and 222 are identical, only the leg-receiving receptacle 222 secured to the outboard end 118 of the platform 102 will be described. The description of the other leg-receiving receptacle 220 is similar.

As shown in FIG. 8, the leg-receiving receptacle 222 forms a downwardly-facing inverted U-shaped channel 280 including first and second downwardly-extending portions 282 and 284 extending generally transversely to the longitudinal central axis of the platform 102. The open ends of the first and second downwardly-extending portions 282 and 284 are configured to form first and second inwardly-turned lip portions 286 and 288 as shown in FIGS. 7–9. The upper bracket 240 includes an upwardly-extending portion 290 adjacent the other end 246 thereof which forms an outwardly-turned lip portion 292 adapted for engagement with the inwardly-turned lip portion 288 of the leg-receiving receptacle 222.

As shown in FIG. 8, an upper latch 300 is pivotally coupled to the upper bracket 240 adjacent the one end 244 thereof. The upper latch 300 includes a first generally upwardly-extending portion 302 having an outwardly-turned lip portion 304 adapted for engagement with the other inwardly-turned lip portion 286 of the leg-receiving receptacle 222 for releasably securing the upper bracket 240 to the leg-receiving receptacle. The upper latch 300 includes a second outwardly-extending portion 306 providing a leg release handle and a middle portion 308 pivotally coupled to the upper bracket 240 for pivoting movement about a third axis 310 (shown in FIG. 9) disposed generally transversely to the longitudinal central axis 104 of the platform 102 between (I) a first orientation, shown in FIG. 7, in which the outwardly-turned lip portion 304 of the first generally upwardly-extending portion 302 of the upper latch 300 engages the inwardly-turned lip portion 286 of the leg-receiving receptacle 222 to releasably secure the upper bracket 240 to the leg-receiving receptacle, and (ii) a second orientation, shown in FIG. 8, in which the outwardly-turned lip portion 304 of the first generally upwardly-extending portion 302 of the upper latch 300 disengages from the inwardly-turned lip portion 286 of the leg-receiving receptacle 222 to free the platform support leg 108.

As shown in FIG. 7, the upper latch 300 further includes a spring 312 for biasing the upper latch toward the first orientation thereof in which the outwardly-turned lip portion 304 of the first generally upwardly-extending portion 302 of the upper latch 300 engages the inwardly-turned lip portion 286 of the leg-receiving receptacle 222 to releasably secure the upper bracket 240 to the leg-receiving receptacle. The outwardly-turned lip portion 304 of the generally upwardly-extending first portion 302 of the upper latch 300 disengages from the other inwardly-turned lip portion 286 of the leg-receiving receptacle 222, as shown in FIGS. 8 and 9, in response to the movement of the leg release handle 306 to free the platform support leg 108 from the leg-receiving receptacle, for example, to move the platform support leg to the other end of the platform 102.

The upper bracket 240 and the two leg-receiving receptacles 220 and 222 are illustratively formed from a high strength, light weight plastic material by extrusion, but they may very well be formed from any other suitable material—such as high strength, light weight metal extrusion.

Although the invention has been described in detail with reference to certain illustrated embodiments, variations and modifications exist within the scope and spirit of the present invention as described and defined in the following claims.

What is claimed is:

1. A hand table assembly for attachment to a patient support deck located on a floor, the patient support deck having an articulatable back section, the hand table assembly comprising:

a generally planar platform having a longitudinal central axis extending generally parallel to a length dimension thereof, a platform attachment mechanism for coupling an end of the platform to a side of the patient support deck, a platform support leg, and a platform support leg attachment mechanism comprising:

a leg-receiving receptacle coupled to the underside of the platform, a lower bracket coupled to a head end of the support leg, the lower bracket having an outwardly-extending portion at one end thereof, an upper bracket supported on the lower bracket and having an outwardly-extending portion at one end thereof which is pivotably coupled to the outwardly-extending portion of the lower bracket about a first axis disposed generally transversely to the longitudinal central axis of the platform, a lower latch coupled to the lower bracket at the other end thereof configured to releasably secure the other end of the upper bracket to the other end of the lower bracket, and an upper latch coupled to the upper bracket configured to releasably secure the upper bracket to the leg-receiving receptacle.

2. The hand table assembly of claim 1, wherein the leg-receiving receptacle is coupled to the underside of the platform at one end thereof.

3. The hand table assembly of claim 2, wherein the platform support leg is extendable.

4. The hand table assembly of claim 3, further including a support leg storage latch comprising a retaining pin secured to the underside of the platform at the other end thereof, wherein the support leg can be folded and locked in a storage position under the platform by pivoting the support leg about the first axis so that it extends generally parallel to the length dimension of the platform on the underside thereof and extending the support leg to cause the retaining pin to enter a retaining pin-receiving receptacle disposed in a foot end of the support leg to lock it in place.

5. The hand table assembly of claim 4, wherein the extendable support leg includes at least two telescopic sections and a latch for locking the telescopic sections in place.

6. The hand table assembly of claim 1, wherein the lower latch has a generally upwardly-extending first portion having an inwardly-turned lip portion adapted for engagement with the other end of the upper bracket for releasably securing the other end of the upper bracket to the other end of the lower bracket.

7. The hand table assembly of claim 6, wherein the lower latch has a second generally downwardly-extending portion providing a leg storage release handle and a middle portion pivotally coupled to the lower bracket for pivoting movement about a second axis disposed generally transversely to the longitudinal central axis of the platform between (I) a first orientation in which the inwardly-turned lip portion of the generally upwardly-extending first portion of the lower latch engages the other end of the upper bracket for releasably securing the lower bracket to the upper bracket, and (ii) a second orientation in which the inwardly-turned lip portion of the generally upwardly-extending first portion of the lower latch disengages from the other end of the upper bracket to free the support leg to pivot about the first axis.

8. The hand table assembly of claim 7, wherein the lower latch further includes a spring for biasing the lower latch toward the first orientation thereof in which the inwardly-turned lip portion of the generally upwardly-extending first portion of the lower latch engages the other end of the upper bracket for releasably securing the lower bracket to the upper bracket, wherein the inwardly-turned lip portion of the generally upwardly-extending first portion of the lower latch disengages from the other end of the upper bracket to free the support leg to pivot about the first axis in response to movement of the leg storage release handle.

9. The hand table assembly of claim 1, wherein the leg-receiving receptacle has a downwardly-facing inverted U-shaped channel comprising first and second downwardly-extending portions extending generally transversely to the longitudinal central axis of the platform, the first and second downwardly-extending portions having inwardly-turned lip portions, wherein the upper bracket has an upwardly-extending portion adjacent the other end thereof having an outwardly-turned lip portion adapted for engagement with one of the inwardly-turned lip portions of the leg-receiving receptacle, wherein the upper latch is coupled to the upper bracket adjacent the one end of thereof and is provided with a generally upwardly-extending first portion having an outwardly-turned lip portion adapted for engagement with the other of the inwardly-turned lip portions of leg-receiving receptacle for releasably securing the upper bracket to the leg-receiving receptacle.

10. The hand table assembly of claim 9, wherein the upper latch has a second outwardly-extending portion providing a leg release handle and a middle portion pivotally coupled to the upper bracket for pivoting movement about a third axis disposed generally transversely to the longitudinal central axis of the platform between a first orientation in which the outwardly-turned lip portion of the generally upwardly-extending first portion of the upper latch engages the other of the inwardly-turned lip portions of receptacle to releasably secure the upper bracket to the receptacle and a second orientation in which the outwardly-turned lip portion of the generally upwardly-extending first portion of the upper latch disengages from the other of the inwardly-turned lip portions of the leg-receiving receptacle.

11. The hand table assembly of claim 10, wherein the upper latch further includes a spring for biasing the upper latch toward the first orientation thereof in which the outwardly-turned lip portion of the generally upwardly-extending first portion of the upper latch engages the other of the inwardly-turned lip portions of receptacle to releasably secure the upper bracket to the receptacle, wherein the outwardly-turned lip portion of the generally upwardly-extending first portion of the upper latch disengages from the other of the inwardly-turned lip portions of the leg-receiving receptacle in response to the movement of the release handle to free the support leg from the leg-receiving receptacle.

12. A hand table apparatus for use with a patient support apparatus during surgery, the hand table apparatus comprising an armboard assembly including a platform and an attachment assembly coupled to the platform, the armboard assembly having an upwardly facing top side and a downwardly facing underside, the attachment assembly being adapted to allow the armboard assembly to be selectively attached to and detached from the patient support apparatus, the armboard assembly including a receptacle, and a leg assembly including a leg and a coupling assembly coupled to the leg, the coupling assembly being configured to allow the leg assembly to be selectively attached to and detached from the armboard assembly, at least a portion of the coupling assembly being received in the receptacle when the leg assembly is attached to the armboard assembly, and the leg being pivotable between a use position extending away from the underside and a storage position adjacent the underside when the leg assembly is attached to the armboard assembly, the coupling assembly including a latch movable between a first position engaging the receptacle to lock the leg assembly to the armboard assembly and a second position disengaged from the receptacle to unlock the leg assembly from the armboard assembly, the latch being spring biased toward the first position.

13. The hand table apparatus of claim 12, wherein the coupling assembly includes a second latch that locks the leg in the use position.

14. The hand table apparatus of claim 13, wherein the second latch is located outside the receptacle.

15. A hand table apparatus for use with a patient support apparatus during surgery, the hand table apparatus comprising an armboard assembly including a platform and an attachment assembly coupled to the platform, the armboard assembly having an upwardly facing top side and a downwardly facing underside, the attachment assembly being adapted to allow the armboard assembly to be selectively attached to and detached from the patient support apparatus, the armboard assembly including a receptacle, and a leg assembly including a leg and a coupling assembly coupled to the leg, the coupling assembly being configured to allow the leg assembly to be selectively attached to and detached from the armboard assembly, at least a portion of the coupling assembly being received in the receptacle when the leg assembly is attached to the armboard assembly, and the leg being pivotable between a use position extending away from the underside and a storage position adjacent the underside when the leg assembly is attached to the armboard assembly, wherein the coupling assembly includes a first bracket, a second bracket pivotably coupled to the first bracket, and a latch movably coupled to the second bracket, at least a portion of the first bracket is received in the receptacle when the leg assembly is attached to the armboard assembly, the leg is coupled to the second bracket to pivot therewith, and the latch is movable between a locking position engaging the first bracket to prevent the second bracket and leg from pivoting relative to the first bracket and a releasing position disengaged from the first bracket to allow the second bracket and leg to pivot relative to the first bracket.

16. The hand table apparatus of claim 15, wherein the coupling assembly further includes a second latch coupled to the first bracket and a portion of the second latch is received in the receptacle when the leg assembly is attached to the armboard assembly.

17. The hand table apparatus of claim 15, wherein the first bracket includes a first planar member, the second bracket includes a second planar member, and the second planar member abuts the first planar member when the leg is in the use position.

18. The hand table apparatus of claim 15, wherein the latch is biased toward the locking position.

19. The hand table apparatus of claim 18, wherein the first bracket includes a planar member having an end edge, the latch includes a cam surface and a locking surface, and the cam surface engages the first bracket during movement of the leg from the storage position to the use position so that the latch snaps over the end edge of the planar member into the locking position in which the locking surface of the latch engages the planar member adjacent the end edge.

20. The hand table apparatus of claim 18, wherein the latch is biased toward the locking position by a spring.

21. The hand table apparatus of claim 12, wherein the leg is lockable in the storage position.

22. A hand table apparatus for use with a patient support apparatus during surgery, the hand table apparatus comprising an armboard assembly including a platform and an attachment assembly coupled to the platform, the armboard assembly having an upwardly facing top side and a downwardly facing underside, the attachment assembly being adapted to allow the armboard assembly to be selectively attached to and detached from the patient support apparatus, the armboard assembly including a receptacle, and a leg assembly including a leg and a coupling assembly coupled to the leg, the coupling assembly being configured to allow the leg assembly to be selectively attached to and detached from the armboard assembly, at least a portion of the coupling assembly being received in the receptacle when the leg assembly is attached to the arm board assembly, and the leg being pivotable between a use position extending away from the underside and a storage position adjacent the underside when the leg assembly is attached to the armboard assembly, wherein the armboard assembly includes a pin coupled to the platform, and the leg includes a pin-receiving receptacle that receives the pin to lock the leg in the storage position.

23. The hand table apparatus of claim 22, wherein the leg includes a floor-engaging surface at an end thereof and the pin-receiving receptacle includes an opening formed in the floor-engaging surface.

24. The hand table apparatus of claim 22, wherein the leg includes a first section and a second section that extends and retracts relative to the first section, and the pin-receiving receptacle is formed in the second section.

25. The hand table apparatus of claim 12, wherein the armboard assembly includes a member coupled to the platform, and the member includes the receptacle.

26. The hand table apparatus of claim 25, wherein the receptacle is formed as a channel in the member.

27. The hand table apparatus of claim 12, wherein the receptacle includes a first side portion, a second side portion spaced-apart from the first side portion, a first lip appended to the first side portion, and a second lip appended to the second side portion, and wherein the coupling assembly includes a bracket and the latch is movably coupled to the bracket, the bracket having a first portion that engages the first lip, and the latch having a second portion that engages the second lip.

28. A hand table apparatus for use with a patient support apparatus during surgery, the hand table apparatus comprising an armboard assembly including a platform and an attachment assembly coupled to the platform, the armboard assembly having an upwardly facing top side and a downwardly facing underside, the attachment assembly being adapted to allow the armboard assembly to be selectively attached to and detached from the patient support apparatus, the armboard assembly including a receptacle, and a leg assembly including a leg and a coupling assembly coupled to the leg, the coupling assembly being configured to allow the leg assembly to be selectively attached to and detached from the armboard assembly, at least a portion of the coupling assembly being received in the receptacle when the leg assembly is attached to the armboard assembly, and the leg being pivotable between a use position extending away from the underside and a storage position adjacent the underside when the leg assembly is attached to the armboard assembly, wherein the armboard assembly includes a member coupled to the platform, and the member includes the receptacle, wherein the member includes a first side portion, a second side portion spaced-apart from the first side portion, a first lip appended to the first side portion, and a second lip appended to the second side portion, and wherein the coupling assembly includes a bracket and a latch movably coupled to the bracket, the bracket having a first portion that engates the first lip, and the latch having a second portion that engages the second lip.

29. The hand table apparatus of claim 28, wherein the first portion and second portion are received in the receptacle when the leg assembly is attached to the armboard assembly.

30. The hand table apparatus of claim 28, wherein the latch is pivotable relative to the bracket between a locking position engaging the second lip to prevent detachment of the leg assembly from the armboard assembly and a releasing position disengaged from the second lip to allow detachment of the leg assembly from the armboard assembly.

31. A hand table apparatus for use with a patient support apparatus during surgery, the hand table apparatus comprising an armboard assembly including a platform and an attachment assembly coupled to the platform, the armboard assembly having a first end, a second end, an upwardly facing top side extending between the first and second ends, and a downwardly facing underside extending between the first and second ends, the attachment assembly being adapted to allow the armboard assembly to be selectively attached to and detached from the patient support apparatus, the armboard assembly including a first receptacle near the first end and a second receptacle near the second end, and a leg assembly including a leg and a coupling assembly coupled to the leg, the coupling assembly being configured to allow the leg assembly to be selectively attached to and detached from the armboard assembly, the coupling assembly including a portion received in the first receptacle when the leg assembly is attached to the armboard assembly near the first end, and the portion of the coupling assembly being received in the second receptacle when the leg assembly is attached to the armboard assembly near the second end.

32. The hand table apparatus of claim 31, wherein the leg is pivotable between a first use position extending away from the underside and a first storage position adjacent the underside when the leg assembly is attached to the armboard assembly near the first end and the leg is pivotable between a second use position extending away from the underside and a second storage position adjacent the underside when the leg assembly is attached to the armboard assembly near the second end.

33. The hand table apparatus of claim 32, wherein the coupling assembly includes a latch that locks the leg in the first use position when the leg assembly is attached to the armboard assembly near the first end and that locks the leg in the second use position when the leg assembly is attached to the armboard assembly near the second end.

34. The hand table apparatus of claim 33, wherein the latch is located outside the first receptacle when the leg is locked in the first use position and the latch is located outside the second receptacle when the leg is locked in the second use position.

35. The hand table apparatus of claim 31, wherein the coupling assembly includes a first bracket, a second bracket pivotably coupled to the first bracket, and a latch movably coupled to the second bracket, the leg is coupled to the second bracket to pivot therewith, and the latch is movable between a locking position engaging the first bracket to prevent the second bracket and leg from pivoting relative to the first bracket and a releasing position disengaged from the first bracket to allow the second bracket and leg to pivot relative to the first bracket.

36. The hand table apparatus of claim 35, wherein the coupling assembly further includes a second latch coupled to the first bracket, a locking portion of the second latch is received in the first receptacle when the leg assembly is attached to the armboard assembly near the first end, and the locking portion of the second latch is received in the second receptacle when the leg assembly is attached to the armboard assembly near the second end.

37. The hand table apparatus of claim 35, wherein the first bracket includes a first planar member, the second bracket includes a second planar member, and the second planar member abuts the first planar member when the leg is in the use position.

38. The hand table apparatus of claim 35, wherein the latch is biased toward the locking position.

39. The hand table apparatus of claim 38, wherein the first bracket includes a planar member having an end edge, the latch includes a cam surface and a locking surface, and the cam surface engages the first bracket during movement of the leg from each of the first and second storage positions to the respective first and second use positions so that the latch snaps over the end edge of the planar member into the locking position in which the locking surface of the latch engages the planar member adjacent the end edge.

40. The hand table apparatus of claim 32, wherein the leg is lockable in the first storage position and the leg is lockable in the second storage position.

41. The hand table apparatus of claim 32, wherein the armboard assembly includes a first pin coupled to the platform, and a second pin coupled to the platform, the leg includes a pin-receiving receptacle that receives the first pin to lock the leg in the first storage position, and the pin-receiving receptacle receives the second pin to lock the leg in the second storage position.

42. The hand table apparatus of claim 41, wherein the leg includes a floor-engaging surface at an end thereof and the pin-receiving receptacle includes an opening formed in the floor-engaging surface.

43. The hand table apparatus of claim 41, wherein the leg includes a first section and a second section that extends and retracts relative to the first section, and the pin-receiving receptacle is formed in the second section.

44. The hand table apparatus of claim 31, wherein the armboard assembly includes a first member coupled to the platform, and a second member coupled to the platform, the first member is formed to include the first receptacle, and the second member is formed to include the second receptacle.

45. The hand table apparatus of claim 44, wherein the first receptacle is formed as a first channel in the first member and the second receptacle is formed as a second channel in the second member.

46. The hand table apparatus of claim 44, wherein the first and second members each include a first side portion, a second side portion spaced-apart from the first side portion, a first lip appended to the first side portion, and a second lip appended to the second side portion.

47. The hand table apparatus of claim 46, wherein the coupling assembly includes a bracket and a latch movably coupled to the bracket, the bracket and the latch providing the portion of the coupling assembly received in the first receptacle when the leg assembly is attached to the armboard assembly adjacent the first end, and the bracket and the latch providing the portion of the coupling assembly received in the second receptacle when the leg assembly is attached to the armboard assembly adjacent the second end.

48. The hand table apparatus of claim 47, wherein the latch has a locking position engaging the second lip of the respective first and second members to prevent detachment of the leg assembly from the armboard assembly when the leg assembly is attached to the armboard assembly adjacent the first and second ends, respectively, and the latch has a releasing position disengaged from the second lip of the respective first and second members to allow detachment of the leg assembly from the armboard assembly when the leg assembly is attached to the armboard assembly adjacent the first and second ends, respectively.

49. A hand table apparatus for use with a patient support apparatus during surgery, the hand table apparatus comprising an armboard assembly having a platform and an attachment assembly coupled to the platform, the platform including a first end, a second end, an upwardly facing top side extending between the first and second ends, and a downwardly facing underside extending between the first and second ends, the attachment assembly being adapted to allow the armboard assembly to be selectively attached to and detached from the patient support apparatus, the armboard assembly including a first member mounted to the underside and a second member mounted to the underside, and a leg assembly including a leg and a coupling assembly coupled to the leg, the coupling assembly being configured to allow the leg assembly to be selectively attached to and detached from each of the first and second members.

50. The hand table apparatus of claim 49, wherein the leg is pivotable between a first use position extending away from the underside and a first storage position adjacent the underside when the leg assembly is attached to the first member and the leg is pivotable between a second use position extending away from the underside and a second storage position adjacent the underside when the leg assembly is attached to the second member.

51. The hand table apparatus of claim 50, wherein the coupling assembly includes a latch that locks the leg in the first use position when the leg assembly is attached to the first member and that locks the leg in the second use position when the leg assembly is attached to the second member.

52. The hand table apparatus of claim 51, wherein the latch is spaced apart from the first member when the leg is locked in the first use position and the latch is spaced apart from the second member when the leg is locked in the second use position.

53. The hand table apparatus of claim 49, wherein the coupling assembly includes a first bracket, a second bracket pivotably coupled to the first bracket, and a latch movably coupled to the second bracket, the leg is coupled to the second bracket to pivot therewith, and the latch is movable between a locking position engaging the first bracket to prevent the second bracket and leg from pivoting relative to the first bracket and a releasing position disengaged from the first bracket to allow the second bracket and leg to pivot relative to the first bracket.

54. The hand table apparatus of claim 53, wherein the coupling assembly further includes a second latch coupled to the first bracket, a locking portion of the second latch engages the first member when the leg assembly is attached to the first member, and the locking portion of the second latch engages the second member when the leg assembly is attached to the second member.

55. The hand table apparatus of claim 53, wherein the first bracket includes a first planar member, the second bracket includes a second planar member, and the second planar member abuts the first planar member when the leg is in the use position.

56. The hand table apparatus of claim 53, wherein the latch is biased toward the locking position.

57. The hand table apparatus of claim 56, wherein the first bracket includes a planar member having an end edge, the latch includes a cam surface and a locking surface, and the cam surface engages the first bracket during movement of the leg from each of the first and second storage positions to the respective first and second use positions so that the latch snaps over the end edge of the planar member into the locking position in which the locking surface of the latch engages the planar member adjacent the end edge.

58. The hand table apparatus of claim 50, wherein the leg is lockable in the first storage position and the leg is lockable in the second storage position.

59. The hand table apparatus of claim 50, wherein the armboard assembly includes a first pin coupled to the platform, and a second pin coupled to the platform, the leg includes a pin-receiving receptacle that receives the first pin to lock the leg in the first storage position, and the pin-receiving receptacle receives the second pin to lock the leg in the second storage position.

60. The hand table apparatus of claim 59, wherein the leg includes a floor-engaging surface at an end thereof and the pin-receiving receptacle includes an opening formed in the floor-engaging surface.

61. The hand table apparatus of claim 59, wherein the leg includes a first section and a second section that extends and retracts relative to the first section, and the pin-receiving receptacle is formed in the second section.

62. The hand table apparatus of claim 49, wherein the first member is formed to include a first receptacle, the second member is formed to include a second receptacle, a portion of the coupling assembly is received in the first receptacle when the leg assembly is attached to the first member, and the portion is received in the second receptacle when the leg assembly is attached to the second member.

63. The hand table apparatus of claim 62, wherein the first receptacle is formed as a first channel in the first member and the second receptacle is formed as a second channel in the second member.

64. The hand table apparatus of claim 62, wherein the first and second members each include a first side portion, a second side portion spaced-apart from the first side portion, a first lip appended to the first side portion, and a second lip appended to the second side portion.

65. The hand table apparatus of claim 64, wherein the coupling assembly includes a bracket and a latch movably coupled to the bracket, the bracket and the latch providing the portion of the coupling assembly received in the first receptacle when the leg assembly is attached to the first member, and the bracket and the latch providing the portion of the coupling assembly received in the second receptacle when the leg assembly is attached to the second member.

66. The hand table apparatus of claim 65, wherein the latch has a locking position engaging the second lip of the respective first and second members to prevent detachment of the leg assembly from the armboard assembly when the leg assembly is attached to the armboard assembly adjacent the first and second ends, respectively, and the latch has a releasing position disengaged from the second lip of the respective first and second members to allow detachment of the leg assembly from the armboard assembly when the leg assembly is attached to the armboard assembly adjacent the first and second ends, respectively.

67. A hand table apparatus for use with a patient support apparatus during surgery, the hand table apparatus comprising an armboard assembly including a platform and an attachment assembly coupled to the platform, the armboard assembly having an upwardly facing top side and a downwardly facing underside, the attachment assembly being adapted to allow the armboard assembly to be selectively attached to and detached from the patient support apparatus, the armboard assembly including a receptacle, and a leg assembly including a leg and a coupling assembly coupled to the leg, the coupling assembly being configured to allow the leg assembly to be selectively attached to and detached from the armboard assembly, at least a portion of the coupling assembly being received in the receptacle when the leg assembly is attached to the armboard assembly, and the leg being pivotable between a use position extending away from the underside and a storage position adjacent the underside when the leg assembly is attached to the armboard assembly, the coupling assembly including a bracket and a latch movably coupled to the bracket, the bracket engaging a first portion of the receptacle and the latch engaging a second portion of the receptacle spaced apart from the first portion when the leg assembly is attached to the arm board assembly.

68. A hand table apparatus for use with a patient support apparatus during surgery, the hand table apparatus comprising an armboard assembly including a platform and an attachment assembly coupled to the platform, the armboard assembly having an upwardly facing top side and a downwardly facing underside, the attachment assembly being adapted to allow the armboard assembly to be selectively attached to and detached from the patient support apparatus, the armboard assembly including a receptacle, and a leg assembly including a leg and a coupling assembly coupled to the leg, the coupling assembly being configured to allow the leg assembly to be selectively attached to and detached from the armboard assembly, at least a portion of the coupling assembly being received in the receptacle when the leg assembly is attached to the armboard assembly, and the leg being pivotable about a pivot axis between a use position extending away from the underside and a storage position adjacent the underside when the leg assembly is attached to the armboard assembly, the pivot axis being spaced apart and offset from the receptacle.

* * * * *